United States Patent [19]

Cristiani

[11] 4,117,851

[45] Oct. 3, 1978

[54] TOBACCO ROD FORMING APPARATUS IN CIGARETTE MAKERS

[76] Inventor: Athos Cristiani, Via Don Luigi, Sturzo 7, Bologna, Italy

[21] Appl. No.: 729,743

[22] Filed: Oct. 6, 1976

[30] Foreign Application Priority Data

Nov. 18, 1975 [IT] Italy ..... 12888 A/75

[51] Int. Cl.[2] ..... A24C 5/18

[52] U.S. Cl. ..... 131/84 B; 131/110

[58] Field of Search ..... 131/84 R, 84 B, 84 C, 131/110, 20 R, 21 R; 198/447, 452; 302/11, 27

[56] References Cited

U.S. PATENT DOCUMENTS

| | | | |
|---|---|---|---|
| 589,121 | 8/1897 | Carper | 131/84 R |
| 3,039,473 | 6/1962 | Schubert | 313/84 C |
| 3,548,837 | 12/1970 | Cristiani | 131/110 X |
| 3,645,273 | 2/1972 | Richter | 131/84 B |

FOREIGN PATENT DOCUMENTS

| | | | |
|---|---|---|---|
| 1,105,786 | 3/1968 | United Kingdom | 131/84 B |

*Primary Examiner*—Stephen C. Pellegrino
*Attorney, Agent, or Firm*—Spencer & Kaye

[57] ABSTRACT

In a cigarette maker, improved means for condensing a shower of cut tobacco and for transferring the condensed cut tobacco on to a moving suction tape to form a tobacco rod or braid without sudden and severe changes in speed and direction when the cut tobacco is being transferred on to the tape.

4 Claims, 3 Drawing Figures

TOBACCO ROD FORMING APPARATUS IN CIGARETTE MAKERS

This invention relates generally to cigarette makers and more particularly to apparatus and the method of forming cut tobacco into a tobacco rod subsquentially wrapped in a paper tape to form a continuous cigarette rod which is then cut into single cigarettes of equal length.

It is well known to form a tobacco rod on an endless suction tape by uniformly delivering tobacco to the tape using a smooth-wall conforming duct through which the tobacco is drawn, thread by thread, in an ascending air current to the tape which closes the duct. The tobacco threads pneumatically adhere to the tape while being formed in the shape of a strip conforming to the desired rod.

It is also known to form a tobacco rod, as shown in my U.S. Pat. No. 3,548,837, by providing a carding drum and picker roller which cooperate to distribute a very thin layer of cut tobacco on to a large movable supporting band. This thin layer of cut tobacco is then assembled and condensed along two lines which converge into a single middle longitudial line to form the tabacco rod in the advancing direction of the surface of the movble support carrying the thin layer of cut tobacco.

When forming the cut tobacco rod as indicated in the first instance, the cut tobacco threads which are carried by the ascending air flow in said duct, are moved at a speed and direction substantially perpendicular to the direction of movement of the pneumatic or suction collecting tape. Consequently, during the impact of the threads of tobacco with the tape, these threads are subjected to a sudden vectorial speed and directional change since, being forced by the pneumatic picking effect of the moving tape, they must all of a sudden assume the tape forward speed. This sudden change, substantially consisting of a right-angle speed and direction change, prejudices the uniformity of the cut tobacco distribution on the suction tape which is destined to collect the tobacco in a rod shape. On the other hand, when forming the tobacco rod by the other method, in the cigarette obtained, the cut tobacco threads, in the resulting cigarette, are less regularly distributed than when the thin tobacco layer distributed on the surface of the movable support and pneumatically collected in a direction tranverse to that of the support motion. However, this second method permits the cut tobacco feed hopper to be in line with the garniture bed, providing the advantage of having smaller cigarette maker overall dimensions.

From a strictly functional point of view, it can be seen that both of the foregoing methods involve the formation of a cut tobacco thin layer on a movable support; the cut tobacco being fed to the support by a carding drum and a picker roller as a uniform transverse stream of finely spread tobacco. In the first method, the thin tobacco layer is pneumatically picked up by the duct along a picking line transverse to the direction of the cigarette continuous rod forming path, and, is rearranged, always pneumatically, along a line parallel to this path to be finally delivered to the suction tape at the head of the path formed by the duct. Naturally, this pneumatic cut tobacco rearrangement in the ascending duct is required only in the compact makers in which the bed must be in line with the cut tobacco hopper.

In the other method, however, the thin layer of cut tobacco is collected on the support itself which simultaneously carries while condensing the tobacco layer from both sides towards its middle line along to two oblique lines, in relation to this middle line, which converge in the movable support advancing direction and which flow together at the middle line. With the collected thin layer of cut tobacco a kind of rod is formed which is then pneumatically transferred to the rod forming tape.

Both methods, as already said, give rise to irregularities in the making of the cut tobacco rod or braid which will form the continuous cigarette rod. In the second method, these irregularities arise from the condensation of the thin layer into a rod or braid on the movable support. In the first method, the irregularities arise from the sudden impact of the cut tobacco threads against the rod forming suction tape which pneumatically intercepts them while moving transverse to the ascending motion of the tobacco.

To aviod the foregoing which cause, in different ways, the same irregularities in the cigarette makers provided with in-line cut tobacco rod forming devices, this invention dynamically organizes the cut tobacco along a path parallel to that of the active run of the rod forming line, by obtaining the cut tobacco directly from the uniform tobacco shower removed by the carding drum picker roller and by pneumatically moving this cut tobacco along the path at regularly interspaced points, with a final cut tobacco speed which has, generically for all the threads, a component substantially equal to and concordant with the suction tape speed. The cut tobacco threads during pneumatic transfer from the organizing or forming path to the suction tape, due to the effect of this speed component, will be pneumatically intercepted or received by the tape while they are already moving at the same speed and in the same direction as the advancing speed and direction as the tape. Therefore, the braid formed on the tape will not have distribution irregularities resulting from speed and direction differences between the transferred threads and the tape which receives them, at the moment in which they lie on it as a result of the pneumatic suction maintained through the tape.

Accordingly, an object of the present invention is to provide in a cigarette maker means for forming or organizing cut tobacco threads into a tobacco rod or braid and transferring the rod or braid to a suction tape which eliminates causes heretofore encountered that created irregularities in the rod or braid.

Another object of the present invention is to provide the foregoing means in which the tobacco rod or braid is moving at substantially the same speed and in the same direction as the bottom run of the suction tape to which it is transferred.

And another object of the present invention is to provide the foregoing means having a narrow middle longitudinal channel closed at its top by the bottom run of the suction tape, a plurality of oblique feed channels disposed on both sides of the longitudinal channel, the ends of all of the channels for receiving threads of cut tobacco being disposed adjacent one another along a line normal to the longitudinal channel, the other ends of the oblique channels being longitudinally spaced along and communicating with the longitudinal channel, and pneumatic means for moving threads of cut tobacco along all of the channels.

Still another object of the present invention is to provide the foregoing in which the pneumatic means comprises a suction or vacuum chamber communicating through grilles immediately upstream from the points of communication of the feed channels with the longitudinal channel.

And still another object of the present invention is to provide means for creating a shower of threads of tobacco available to all of the channels at their inlet ends.

The foregoing and other objects and advantages of the invention will appear more fully hereinafter from a consideration of the detailed description which follows, taken together with the accompanying drawing wherein a single embodiment of the invention is illustrated by way of example. It is to be expressly understood, however, that the drawing is for illustration purposes only and is not to be construed as defining the limits of the invention.

Figure 1:
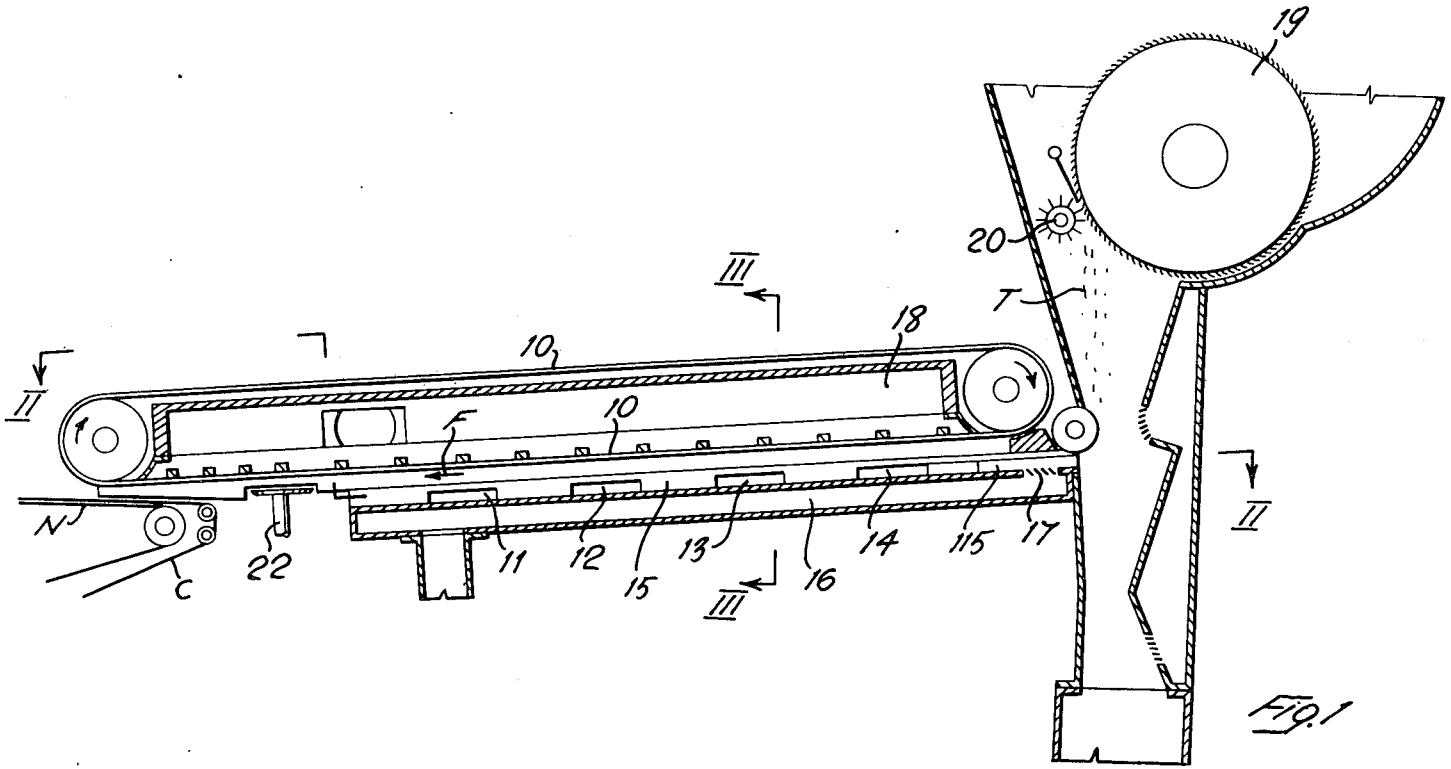
FIG. 1 is a sectional view in elevation diagrammatically illustrating the present invention.
Figure 2:
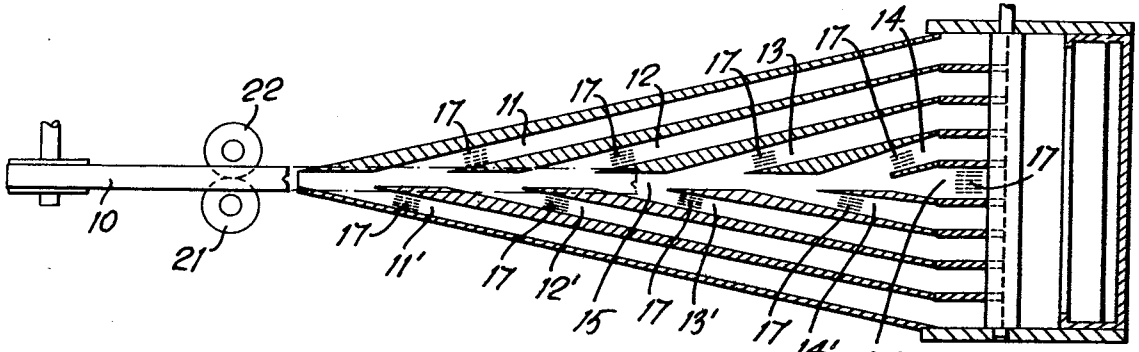
FIGS. 2 and 3 are sectional views taken on lines II—II and III—III, respectively, of FIG. 1.
Figure 3:
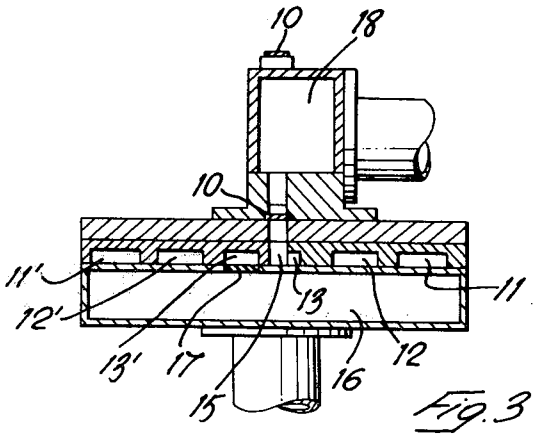

Referring now to the drawings, at the head end of the rod forming section of a cigarette machine a picker roller 20 is provided to strip a thin layer of tobacco from a carding drum 20 to create a wide shower of tobacco T. The wide shower of tobacco T is suitably condensed to provide a tobacco rod or braid on the bottom run of a suction tape 10, in the form of an air pervious endless belt, where the formed braid is regularized by a trimming device 21/22 and is subsequently transferred to a paper wrapping tape C supported by a rod forming section tape N.

In accordance with the present invention, the wide shower of tobacco T is condensed by two sets oblique feed channels 11, 12, 13 and 14, and 11', 12', 13' and 14'; each set of oblique feed channels communicating with and being disposed on a different side of middle longitudinal collecting channel 15. Although each such set is shown and described as consisting of four feed channels, this number is for illustration purposes only and there is no intent to define the limits of the present invention.

As shown, the tops of the two sets of oblique feed channels 11–14 and 11'–14' are closed by fixed walls while bottom run of the tape 10 closes the top of the middle longitudinal collecting channel 15 along its full length. The inlet or picking ends of all the channels are disposed in an orderly manner or series along a line transverse to the direction of the middle longitudinal channel 15 which is parallel to the tape 10. The sets of feed ducts 11–14 and 11'–14' converge in the advancing direction F of the bottom run of the tape 10 with the discharge ends of each set of feed ducts, communicating with the longitudinal channel 15, being offset in a longitudinal direction from the discharge ends of the other set of feed ducts.

Adjacent to or immediately upstream of the outlets or discharge ends, each of the oblique feed channels 11–14 and 11'–14' is provided with a grille 17 for communication with a vacuum or suction chamber or box 16 connected to any suitable well known means (not shown) for maintaining an appropriate vacuum. The short inlet portion 115 of the middle longitudinal channel 15 is also provided with a grille 17 for communication with the vacuum or suction chamber or box 16. The lower run of the endless tape 10 communicates with a vacuum or suction box or chamber 18 connected to any suitable well known means (not shown) for maintaining an appropriate vacuum. As a result of the combined effect of the vacuum or suction chambers or boxes 16 and 18, air flow or currents are created in the feed channels 11–14 and 11'–14', as well as channel section 115, from the channel inlets towards the middle channel 15. The speed of the air flow or currents is several times higher, for instance five or six times higher, than the speed of the tape 10.

Such air flow or currents suck cut tabacco into the inlets or picking ends of the channels 11–14 and 11'–14' where the cut tobacco threads are quickly accelerated by the air streams being drawn through grilles 17 and move past them by inertia, being speeded up, until they dynamically converge into the longitudinal channel 15, where, always provided with that speed, they are taken within the suction flow through the tape 10 to which they adhere, thus forming the tobacco braid.

Since the cut tobacco threads, at the moment they are taken by suction flow through the tape 10, are provided with a motion parallel to and concordant with the motion of that tape, they come to lie gently on the tape without the impact which would occur if they were simply drawn perpendicularly onto the tape. In other words, the cut tobacco threads acquire less suddenly the speed of tape 10, and are not subjected to sudden and severe changes in direction. Furthermore, since the speed of the cut tobacco threads in the feed channels is several times higher than the speed of tape 10 and the lengths of these channels are different from one channel to the other on each side of the middle longitudinal channel 15, there is a regular and efficacious mixture of threads as that obtainable with a transversal collection from a thin layer lying on moving flat support. In fact, since the outlet ends of feed channels 11–14 on one side of the middle longitudinal channel 15 are regularly offset in relation to those of the feed channels 11'–14' on the other side, the threads are brought on tape 10 in distinct positions between each other. This accounts for the regularity of the disposition of the threads of cut tobacco in a so composed braid.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. Apparatus for forming a continuous cut tobacco braid, comprising a narrow endless belt type air permeable tape having a bottom run moving at a predetermined speed in a predetermined direction;

vacuum means for creating a suction through the bottom run of said tape;

means for creating a wide shower of cut tobacco along a line transverse to the direction of movement of the bottom run of said tape;

fixed channel means comprising a longitudinal channel closed at the top by the bottom run of said tape, and a plurality of feed channels closed at the top and disposed oblique relative to said longitudinal channel;

all of said channels having inlet ends disposed in an orderly series along the width of and communicating with said shower to receive cut tobacco;

said feed channels having outlet ends spaced longitudinally along and communicating with said longitudinal channel;

and means for creating air flow in said channel means moving cut tobacco received from said shower at a speed and direction concordant with the speed and direction of said tape when received thereby.

2. The apparatus in accordance with claim 1, and said feed channels being disposed in two sets each on a side of said longitudinal channel opposite from the other;

the outlet ends of each set communicating with said longitudinal channel being longitudinally offset from the outlet ends of the other set.

3. The apparatus in accordance with claim 2, and said air flow creating means comprising a vacuum chamber below said channel means communicating with said feed channels adjacent to and immediately upstream from each outlet end.

4. The apparatus in accordance with claim 3, and said vacuum chamber further communicating with said longitudinal channel adjacent to and immediately downstream from its inlet end.

* * * * *